US007332228B2

(12) United States Patent
Fukaya et al.

(10) Patent No.: US 7,332,228 B2
(45) Date of Patent: Feb. 19, 2008

(54) COATED REFRACTORY METAL PLATE HAVING OXIDE SURFACE LAYER, AND SETTER WHICH USES THE SAME AND WHICH IS USED IN SINTERING

(75) Inventors: Yoshitake Fukaya, Toyama (JP); Hiroshi Yoshida, Toyama (JP); Masahiro Katoh, Toyama (JP)

(73) Assignee: A.L.M.T. Corporation, Tokyo (JP)

( * ) Notice: Subject to any disclaimer, the term of this patent is extended or adjusted under 35 U.S.C. 154(b) by 230 days.

(21) Appl. No.: 10/784,678

(22) Filed: Feb. 24, 2004

(65) Prior Publication Data

US 2004/0166359 A1 Aug. 26, 2004

(30) Foreign Application Priority Data

Feb. 25, 2003 (JP) ..... 2003-047980

(51) Int. Cl.
*B32B 9/00* (2006.01)
*F27D 5/00* (2006.01)

(52) U.S. Cl. ..... 428/469; 428/472; 428/701; 428/702; 432/258

(58) Field of Classification Search ..... 428/469, 428/702
See application file for complete search history.

(56) References Cited

U.S. PATENT DOCUMENTS

| | | | | |
|---|---|---|---|---|
| 3,631,766 A | | 1/1972 | Emmasingel | |
| 4,259,061 A | * | 3/1981 | Dubetsky | 432/13 |
| 5,906,778 A | | 5/1999 | Arai et al. | |
| 6,214,474 B1 | * | 4/2001 | Barbist et al. | 428/469 |
| 2004/0050244 A1 | | 3/2004 | Sakaki et al. | |

FOREIGN PATENT DOCUMENTS

| | | | |
|---|---|---|---|
| GB | 2 117 828 A | | 10/1983 |
| JP | 61-143547 A | | 7/1986 |
| JP | 63-157832 A | | 6/1988 |
| JP | 63157832 A | * | 6/1988 |
| JP | 63-192850 A | | 8/1988 |
| JP | 2-200766 A | | 8/1990 |
| JP | 2764085 B2 | | 4/1998 |
| JP | 2000 353725 A | | 12/2000 |
| JP | 2000-516666 A | | 12/2000 |
| JP | 2002-47581 A | | 2/2002 |
| JP | 2002 295404 A | | 10/2002 |
| JP | 2002363617 A | * | 12/2002 |

OTHER PUBLICATIONS

JIS H 4483-1984, Molybdenum Sheets for Lighting and Electronic Equipments, Japanese Standards Association (1984).

* cited by examiner

*Primary Examiner*—Jennifer C. McNeil
*Assistant Examiner*—Timothy M. Speer
(74) *Attorney, Agent, or Firm*—Sughrue Mion, PLLC

(57) ABSTRACT

A setter used in sintering and having an oxide coating layer is configured such that oxide powder of at least one of, or a mixture of oxide powders of two or more of alumina, silica, zirconia, yttria, titania, magnesia, and calcia is deposited to at least one surface of a metal composed of molybdenum, tungsten, or an alloy of a molybdenum group and a tungsten group, and a deposition surface thereof allows no exposure of the base material.

23 Claims, 7 Drawing Sheets

(x 150)

DEPOSITION SURFACE BY COARSE OXIDE POWDER ($Al_2O_3$ - 43wt% $ZrO_2$)

(x 150)

DEPOSITION SURFACE BY FINE OXIDE POWDER ($Al_2O_3$ - 43wt% $ZrO_2$)

(x 150)

DEPOSITION SURFACE BY MIXTURE OF FINE AND COARSE OXIDE POWDERS ($Al_2O_3$ - 43wt% $ZrO_2$)

(x 150)

COATED
SURFACE

NON-POLISHED
SURFACE

SAMPLE 17 ACCORDING TO REFERENCE EXAMPLE

SAMPLE 8 OF PRESENT INVENTION

SURFACE OF $Al_2O_3$ AFTER HEAT TREATMENT AT 1800°C WHEN POWDER GRAIN SIZE IS 75μm

SURFACE OF $Al_2O_3$ AFTER HEAT TREATMENT AT 1800°C WHEN POWDER GRAIN SIZE IS 1μm

COATED REFRACTORY METAL PLATE HAVING OXIDE SURFACE LAYER, AND SETTER WHICH USES THE SAME AND WHICH IS USED IN SINTERING

The present application claims priority to prior Japanese application JP 2003-47980, the disclosure of which is incorporated herein by reference.

BACKGROUND OF THE INVENTION

The present invention relates to a setter which is used in sintering and which has an oxide coating layer, which is used upon sintering components, and a production method thereof, and further relates to a refractory metal plate having an oxide coating layer, and a production method thereof.

In recent years, production of iron series, copper series, and tungsten series processing objects and components by means of metal injection molding (hereinafter referred to as "MIM") has been put to practical use and, following it, functional demands to a setter used in sintering have been enhanced.

Conventionally, high temperature resistant materials, such as $Al_2O_3$ (hereinafter referred to as "alumina") and $SiO_2$ (hereinafter referred to as "silica"), have been often used for the setter used in sintering.

However, in case of the high temperature resistant material, such as alumina or silica, thickness of the plates should be set to, for example, 10 to 15 mm for proof thermal shock or deformation due to weight of processing objects. Herein, the processing object may be an object to be treated by sintering or heating. On the other hand, when this thick high temperature resistant plate is used, the loading/sintering amount of the objects is limited, and further, enormous energy is required for raising the temperature of a furnace upon sintering, long time is required for lowering the temperature because of the plate's small thermal conductivity.

For solving them, such a setter used in sintering has been demanded that has a less thickness to enable increase of the loading volume of the processing objects, and further, that still maintains the characteristic of the conventional high temperature creep resistance plate.

A plate is made of a refractory metal, such as molybdenum or tungsten, so that the plate is excellent in characteristic of high temperature creep resistance.

As a plate having heat resistance, a molybdenum plate has been proposed in JP-A-S61-143548, JP-A-S63-157832, and JP-A-S63-192850, which will be hereinafter referred to as reference 1, reference 2, and reference 3, respectively. The reference 1 discloses a molybdenum plate made of a pure molybdenum metal added with no dopant, having a size of a disk surface being 15 mm to 150 mm, and provided with crystal grains accounting for ⅕ or more of a thickness in a thickness direction of the plate.

On the other hand, the references 2 and 3 each disclose a molybdenum plate which contains lanthanum oxides arranged in a direction substantially perpendicular to a thickness direction of the plate and, particularly, the reference 3 discloses the molybdenum plate wherein crystal grains exhibit an interlocking structure.

However, when the bare molybdenum plate is used while being brought in contact with MIMed products for sintering thereof, the MIM products being processed are melted and adhered to the surface of the molybdenum plate so that the yield of the sintered products is extremely poor.

In view of this, a molybdenum plate provided with an adhesion preventing layer on the surface thereof is proposed in, for example, JP-A-2002-47581 and JP-B-2764085, which will be hereinafter referred to as references 4 and 5, respectively. The reference 4 discloses that a molybdenum plate doped with lanthanum or lanthanum oxides is buried in powders of a mixture of at least one of aluminum, chromium, and titanium, and alumina to perform a reduction heat treatment to thereby diffuse metal elements into the molybdenum plate from the surface, then a heat treatment is applied thereto in an oxidization atmosphere so that an oxide layer is formed on the surface thereof as the adhesion preventing layer.

On the other hand, the reference 5 discloses that, by plasma spraying molybdenum powder and then alumina powder according to a method of plasma spraying of ceramics, an alumina layer is formed on the surface of a pure molybdenum plate via a composite layer of molybdenum and alumina.

JP-A-2000-516666, which will be hereinafter referred to as reference 6, discloses a parent substance consisting of refractory metals and an oxidation protective coating made of silicides or aluminides. In the parent substance, a reaction barrier layer is formed between the substance and the oxidation protective coating by means of plasma spraying.

Conventionally, there have been a case where the high temperature resistant material such as alumina or silica is used for a plate that is used upon sintering iron series, copper series, or tungsten series objects or components produced by MIM or the like, and a case where the high temperature resistant material such as molybdenum or tungsten is used for such a plate.

In the former case where the high temperature resistant material, such as alumina or silica is used, a thickness of the plate should be set to, for example, 10 to 15 mm for proof thermal shock or deformation due to weight of processing objects. Consequently, there has been a problem that when the thickness of the plate is large, charge amounts of the processing objects are reduced, much energy is required for raising the temperature upon sintering, and further, it takes long time to cool it because of its small thermal conductivity and large specific heat.

In the latter case, since the processing objects and the plate adhere to each other upon sintering, alumina or the like in the form of powder or sheets is interposed therebetween. However, the alumina powder or the like adheres to the processing objects by adhere so that much labor is required for remove before and after the sintering process.

Further, when heated up to 500° C. or higher in the oxidization atmosphere, the molybdenum plate is extremely oxidized and sublimed, therefore, can not be used for sintering in the air.

As disclosed in the references 4 and 5, it has been proposed to form the oxide layer or the ceramic layer on the surface of the molybdenum plate for the purpose of preventing the melting adhesion of the processing objects. However, the formation process is complicated and laborsome.

When molybdenum is present in the uppermost layer of a plurality of surface layers, the MIM products are subjected to the melting adhesion thereto. Further, inasmuch as the layer containing molybdenum is plasma spraying as an underlayer, even if the uppermost layer does not contain molybdenum, molybdenum is liable to enter the outermost surface due to diffusion or the like so that there arises an instance where the melting adhesion between the MIM products and molybdenum setter can not be prevented.

SUMMARY OF THE INVENTION

It is an object of the present invention to provide a refractory metal plate which is capable of preventing the melting adhesion of an MIM product upon sintering thereof, and which is, by reducing a thickness of a plate thereof, capable of largely saving energy and time used for heating and cooling so that an economical effect is large.

It is another object of the present invention to provide a refractory metal plate having both an excellent binder deposit property and an excellent sintering characteristics by providing a porous and smooth oxide coating layer.

"Excellent sintering characteristics" means that sintered body have smooth and flat surface and high density because smooth oxide coating layer surface decreases frictional resistance from sintering contraction.

It is still another object of the present invention to provide a method of producing the foregoing refractory metal plates.

It is yet another object of the present invention to provide a setter used in sintering that can prevent an adhesion inhibitor in the form of powder of alumina or the like from adhering to a product so that a post treatment is not required to achieve an economical effect.

It is a further object of the present invention to provide a setter used in sintering, wherein, upon sintering an iron series material, a base material of the plate is not reacted with components, such as nickel, contained in the iron series material so that the performance of the plate is not degraded.

It is a still further object of the present invention to provide a refractory metal plate that uses a plate material of molybdenum or the like and can be used even in the oxidization atmosphere.

It is a yet further object of the present invention to provide a method of producing the foregoing refractory metal plate.

It is another object of the present invention to provide a setter which is used in sintering and which uses the foregoing refractory metal plate.

For accomplishing the foregoing objects, the present invention is configured such that, for obtaining a setter which is used in sintering and which has an oxide coating layer wherein a base material of the plate is not exposed, a grain size of at least one kind of oxide powder is set to 10 μm or less to thereby improve the sintering characteristic of the oxide so that the oxide layer is tightly adhered at a temperature equal to or less than a melting point.

According to one aspect of the present invention, there is provided a refractory metal plate comprising an oxide coating layer formed by depositing oxide powder of at least one of, or a mixture of oxide powders of two or more of alumina, silica, $ZrO_2$ (hereinafter referred to as "zirconia"), $Y_2O_3$ (hereinafter referred to as "yttria"), $TiO_2$ (hereinafter referred to as "titania"), MgO (hereinafter referred to as "magnesia"), and CaO (hereinafter referred to as "calcia") to at least one surface of a metal composed of one of molybdenum, tungsten, and an alloy of a molybdenum group and a tungsten group. In the aspect of the present invention, the oxide coating layer covers the whole of the at least one surface so as to inhibit exposure of a base material.

According to another aspect of the present invention, there is provided a method of producing the forgoing refractory metal plate. The method comprises the step of forming an oxide coating layer on a surface of a plate by implementing one of sub-steps of (a) forming slurry by mixing oxide with a solvent, painting the slurry with a brush or spraying the slurry-on a base material, drying the slurry on the base material, then applying a melting process at a temperature depending on a grain size of the oxides to be deposited to form an oxide coating layer, (b) forming an oxide coating layer by plasma spraying, and (c) forming an oxide coating layer by the use of a high temperature resistant adhesive, then applying a heat treatment so as to deposit it to form the oxide coating layer.

According to still another aspect of the present invention, there is provided a method of producing a setter which is used in sintering and which is formed by the refractory metal plate obtained by using the foregoing method.

According to a further aspect of the present invention, there is provided a setter which is used in sintering and which is formed by the foregoing refractory metal plate.

According to a still further aspect of the present invention, there is provided a refractory metal plate which comprises a plate with an oxide coating layer formed by depositing oxide powder of at least one of, or a mixture of oxide powders of two or more of alumina, silica, zirconia, yttria, titania, magnesia, and calcia to at least one surface of the plate. In the refractory metal plate, the plate is a molybdenum plate having a composition of 99.9% or more purity and having a high temperature deformation resistant characteristic. A size of a disk-shaped crystal grain contained inside the molybdenum plate is such that a ratio of a longer diameter relative to a shorter diameter of a disk surface is four or less, a diameter of a disk surface of the molybdenum plate is 15 mm to 150 mm, and crystal grains account for ⅕ or more of a thickness in a thickness direction of the molybdenum plate.

According to a yet further aspect of the present invention, there is provided a setter which is used in sintering and which is formed by the foregoing refractory metal plate.

According to another aspect of the present invention, there is provided a method of producing the foregoing refractory metal plate. The method comprises the step of forming an oxide coating layer on a surface of a plate by implementing one of sub-steps of (a) forming slurry by mixing oxide with a solvent, painting the slurry with a brush or spraying the slurry-on a base material, drying the slurry on the base material, then applying a melting process at a temperature depending on a grain size of the oxides to be deposited, (b) forming the oxide coating layer by plasma spraying, and (c) forming an oxide coating layer by the use of a high temperature resistant adhesive, then applying a heat treatment so as to deposit an oxide coating layer on a plate material.

According to still another aspect of the present invention, there is provided a method of producing a setter which is used in sintering and which is formed by the refractory metal plate obtained by using the foregoing method.

According to a further aspect of the present invention, there is provided a refractory metal plate which comprises a plate with an oxide coating layer formed by depositing oxide powder of at least one of, or a mixture of oxide powders of two or more of alumina, silica, zirconia, yttria, titania, magnesia, and calcia to at least one surface of the plate, wherein the plate has a composition of 0.1 to 1.0 wt % lanthanum or lanthanum oxides with the remainder composed of molybdenum, has a structure extending in a substantially fixed direction, and is small in deformation amount at a high temperature.

According to a still further aspect of the present invention, there is provided a setter which is used in sintering and which is formed by the foregoing refractory metal plate.

According to a yet further aspect of the present invention, there is provided a method of producing the foregoing refractory metal plate. In the method, the method comprises the step of forming an oxide coating layer by implementing one of sub-steps of (a) forming slurry by mixing oxide with a solvent, painting the slurry with a brush or spraying the slurry on a base material, drying the slurry on the base material, then applying a melting process at a temperature depending on a grain size of the oxides to be deposited, (b) forming the oxide coating layer by plasma spraying, and (c) forming an oxide coating layer by the use of a high temperature resistant adhesive, then applying a heat treatment so as to deposit the oxide coating layer.

According to another aspect of the present invention, there is provided a method of producing a setter which is used in sintering and which is formed by the refractory metal plate obtained by using the foregoing method.

According to still another aspect of the present invention, there is provided a setter which is used in sintering and which comprises the foregoing refractory metal plate.

BRIEF DESCRIPTION IF THE DRAWING

DESCRIPTION OF THE PREFERRED EMBODIMENTS

The present invention will be described in further detail.

According to the present invention, a refractory metal plate is configured such that oxide powder of at least one of, or a mixture of oxide powders of two or more of alumina, silica, zirconia, yttria, titania, magnesia, and calcia is deposited to molybdenum, tungsten, or an alloy thereof, which is a high temperature resistant material, so as to be formed into an oxide coating layer, and a deposition surface thereof fully covers the molybdenum, the tungsten, or the alloy thereof being a base material. Herein, the alloy contains at least one of molybdenum and tungsten as a main element. Although the refractory metal "plate" is described as a refractory metal component used for sintering in the present specification, the refractory metal component may be used in the form of a tray, a box, a container, and a floor plate.

As a method of the deposition, baking in a high temperature treatment, plasma spraying, or adhesion using a high temperature resistant adhesive may be employed. Using the high temperature deformation resistant material, a thickness of a plate thereof, while it was 10 to 15 mm in case of the conventional high temperature resistant material such as alumina or silica, can be reduced to about 1 to 2 mm, wherein the foregoing oxide layer is firmly adhered onto the molybdenum plate or the like at a contact portion with a processing object. Of the oxides used thereupon, a grain size of at least one kind of oxide powder is set to 10 μm or less to thereby improve the sintering characteristic of the oxides so that the oxide layer can be tightly adhered to the molybdenum plate or the like at a temperature equal to or less than a melting point.

In the description of the present specification, a powder having a grain size of 10 μm or less will be referred to as a fine grain powder while a powder having a grain size more than 10 μm will be referred to as a coarse grain powder.

Now, examples of the present invention will be described with reference to the drawings, wherein a molybdenum setter used in sintering is used as a refractory metal plate, but it is readily understood that the present invention is not limited thereto.

In the preferred embodiment, as an oxide, alumina, silica, zirconia, yttria, titania, magnesia, and calcia are exemplified. However, in the present invention, the oxide is not limited to the above-exemplified oxides but the oxide may be a suboxide, such as titania (TiO) and also be a complex oxide, such as alumina-titania ($Al_2TiO_5$) taking into consideration melting adhesion due to a reaction between a base material and an object to be treated.

Figure 1:
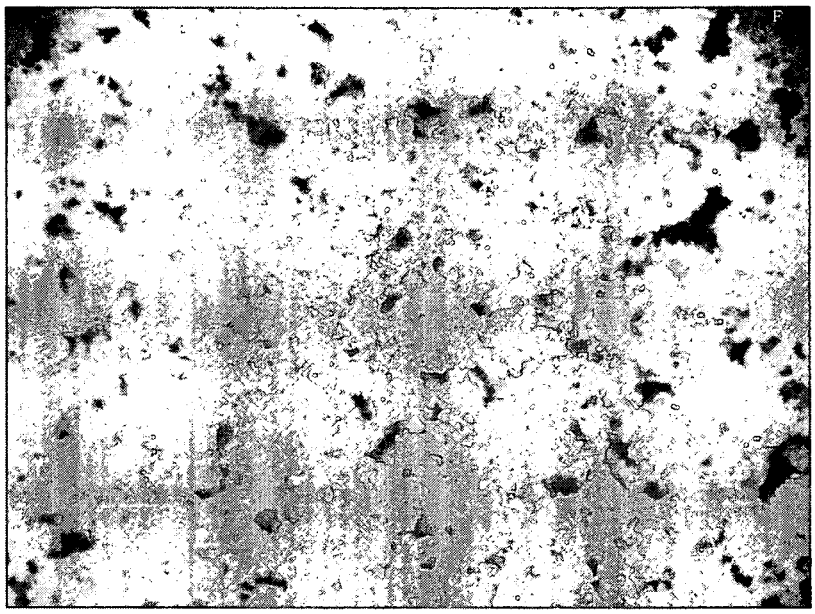
FIG. 1 is a microphotograph (150 magnification) showing a structure of one example of a deposition surface of an oxide coating layer of a setter used in sintering according to the present invention, wherein the state of the deposition surface by coarse oxide powder ($Al_2O_3$-43 wt % $ZrO_2$) is shown.
Figure 2:
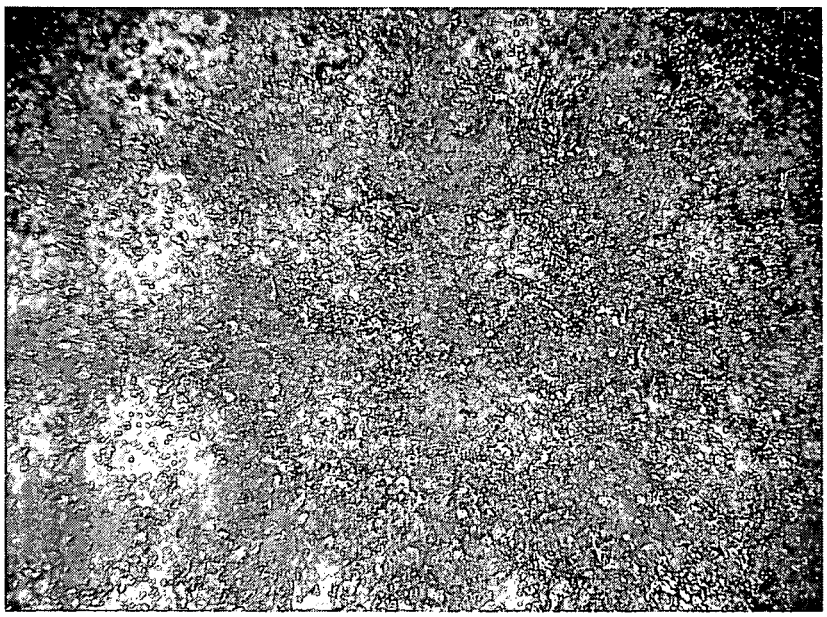
FIG. 2 is a microphotograph (150 magnification) showing a structure of one example of a deposition surface of an oxide coating layer of a setter used in sintering according to the present invention, wherein the state of the deposition surface by fine oxide powder ($Al_2O_3$-43 wt % $ZrO_2$) is shown.
Figure 3:
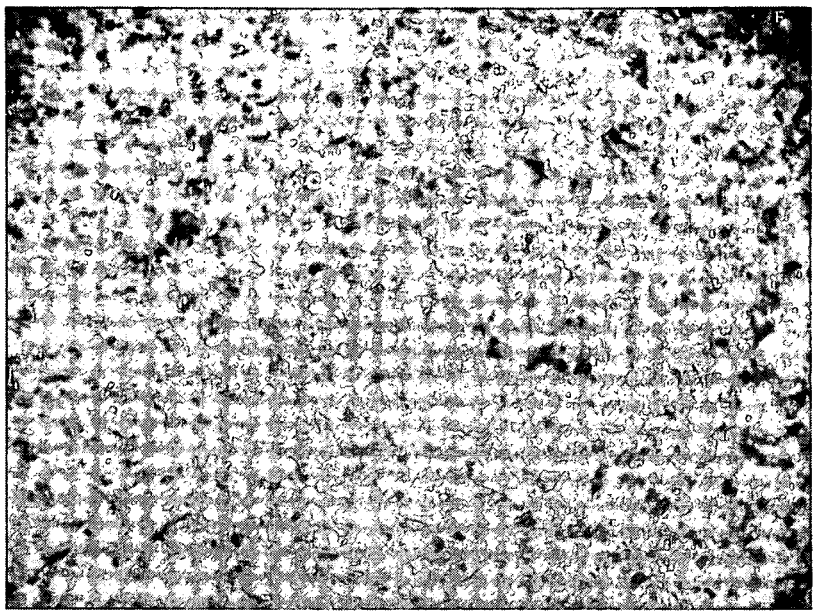
FIG. 3 is a microphotograph (150 magnification) showing a structure of one example of a deposition surface of an oxide coating layer of a setter used in sintering according to the present invention, wherein the state of the deposition surface by a mixture of fine and coarse oxide powders ($Al_2O_3$-43 wt % $ZrO_2$) is shown.

As shown in FIGS. 1 to 3, the surface of the foregoing adhering oxides can be formed porous, or can be formed, at the contact portion with the processing object, with gaps which gas can enter.

Figure 4:
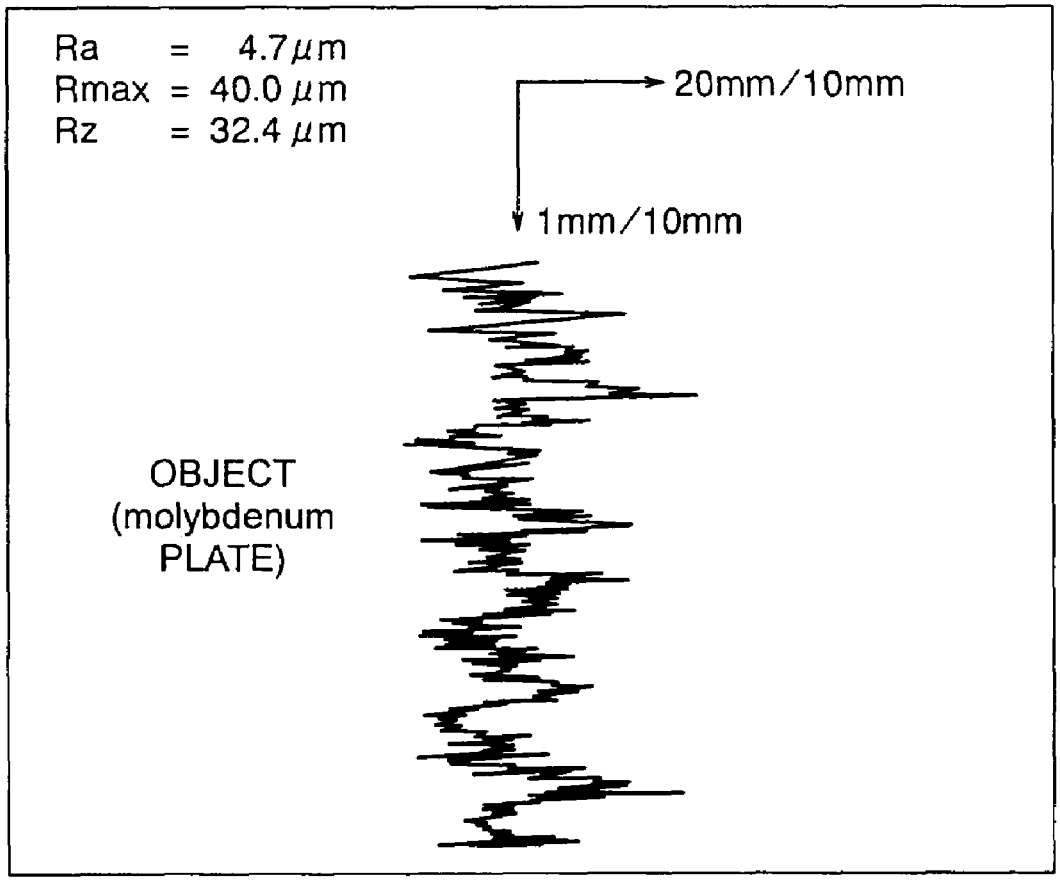
FIG. 4 is a diagram showing a surface roughness of a non-polished surface of the deposition surface ($Al_2O_3$)
Figure 5:
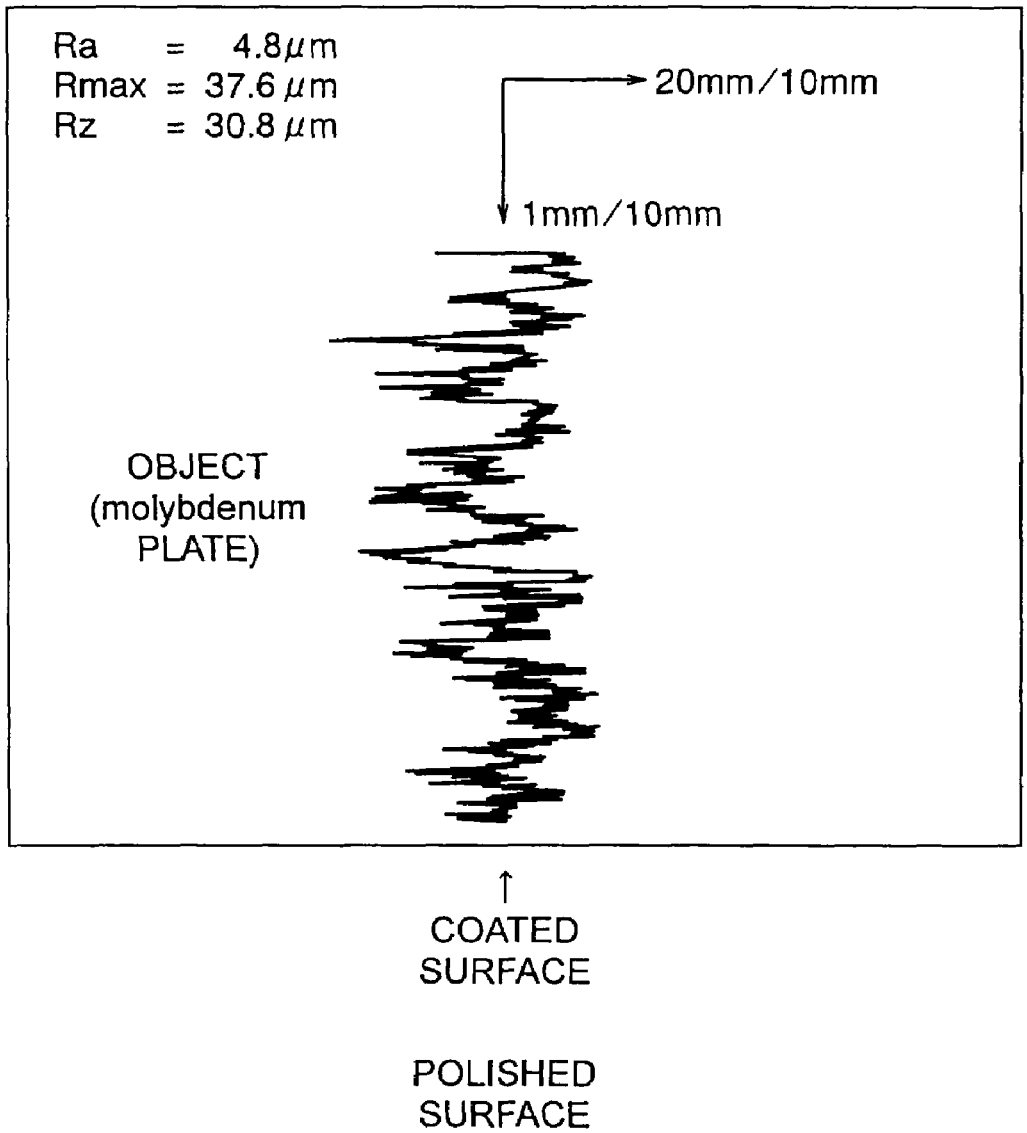
FIG. 5 is a diagram showing a surface roughness of a polished surface of the deposition surface ($Al_2O_3$)

As shown in FIGS. 4 and 5, it is necessary that the surface of the foregoing adhering oxides has a certain smoothness.

Figure 6:
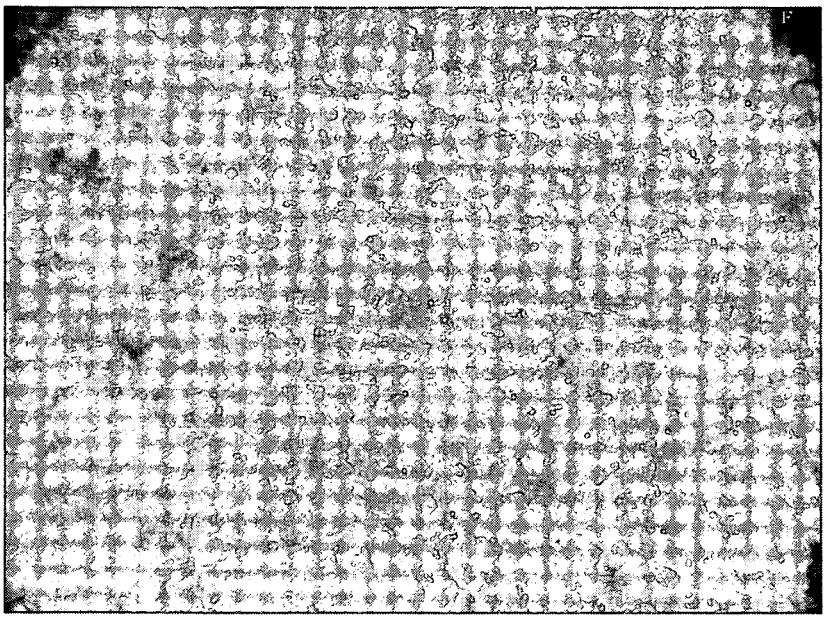
FIG. 6 is a microphotograph showing the state of the deposition surface in FIG. 5.
Figure 7B:
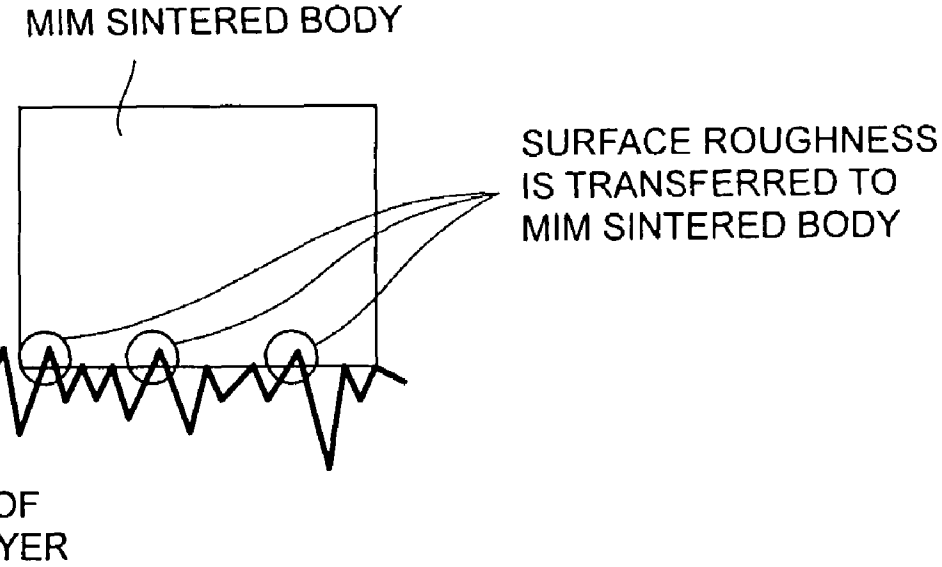
FIG. 7B is a diagram exemplarily showing an influence of a coating layer surface roughness upon an MIM sintered body in reference sample 17.
Figure 7A:
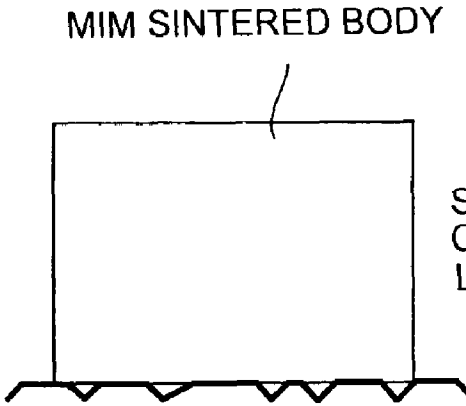
FIG. 7A is a diagram exemplarily showing an influence of a coating layer surface roughness upon an MIM sintered body in sample 8 of the present invention.

As shown in FIGS. 6, 7A and 7B, a further excellent MIM sintered body can be obtained by polishing the surface of the coating layer composed of an oxide coating.

As opposed to sample 8 (which will be described later) of the present invention having the polished surface as shown in FIG. 7A, in case of sample 17 (which will be described later in detail) according to a reference example as shown in FIG. 7B, since large roughness exists on the surface of the coating layer, there arises such an instance where surface roughness is transferred to an MIM sintered body so that it can not be used as a product.

Further, in the present invention, the setter used in sintering can be used at a high temperature region where a heating temperature is within a range of 1000° C. to 1850° C. The surface of the oxides exhibits a smooth and porous surface so that the smoothness minimizes a contraction upon sintering, and the porous surface improves the degassing efficiency upon removing binder. As a result, sintering characteristics can be improved. As described above, the deposition surface of the oxide coating layer composed of the oxides covers the metal composed of molybdenum, tungsten, or the alloy of a molybdenum group and a tungsten group, which is the base material.

In the present invention, the coating that does not expose the base material represents that the exposure of the base material is equal to or less than 1% of a unit area of the oxide coating layer. This is because, when the exposure of the base material exceeds 1% of the unit area of the oxide coating layer, reaction between the base material and a processing object is liable to advance to thereby cause the melting adhesion therebetween or extremely degrade the property of the molybdenum plate, and therefore, it can not be said that the base material is not substantially exposed.

Therefore, conventionally, when the iron series material is sintered, components, such as nickel, contained therein are reacted with molybdenum forming the setter used in sintering to significantly deteriorate the performance of the molybdenum plate. On the other hand, in the present invention, since there is no exposure of the material of the molybdenum plate, the molybdenum plate is not subjected to degradation of its performance, and therefore, can be used.

According to the method titled "Molybdenum Tray and Production Method thereof" of the foregoing reference 5, a coating layer made of heat resistant ceramics is formed on a molybdenum tray. However, this literature describes that the coating layer aims to prevent adhesion between mutual components such as molybdenum trays or floor plates, and does not need to be formed over the whole surface of the base plate, and it is sufficient to form the coating layer at least at portions that are brought into contact with other trays or components upon use. Therefore, the coating layer does not aim to prevent the melting adhesion of the processing object.

On the other hand, in the present invention, the prevention of adhesion is one of the objects and one of the effects. Further, in the present invention, by the use of the fine powder of the oxides, the deposition surface thereof fully covers molybdenum, tungsten, or the alloy thereof, which is the base material, so that a function of preventing the reaction between the base plate and the processing object is added.

In the reference 5, a plasma spraying layer of a mixture of molybdenum powder and ceramic powder is provided on the molybdenum plate, and it is desirable that an uppermost layer portion be substantially a layer of heat resistant ceramics, thereby aiming to prevent adhesion between processing objects or between jigs. Consequently, there is a drawback that the cost is increased for providing such a plurality of layers or the coating layer with a concentration gradient.

On the other hand, in the present invention, by setting the grain size of oxide powder of at least one kind of the oxides to be used to 10 μm or less, the sintering characteristic of the oxides is improved so that, without stacking a plurality of layers, it is possible to obtain a coating layer having a peel strength equivalent to that of 15 to 20 kg/mm$^2$ of the coating layer shown in the reference 5, and having no exposure of molybdenum on the surface to thereby prevent adhesion of the processing object thereto.

Further, in the reference 5, it is described that the plasma spraying coating layer is subjected to a heat treatment at 1500° C. or higher. However, there arises an instance where the plasma spraying coating layer is subjected to a crack due to a difference in thermal expansion between the molybdenum base plate and the coating layer so that the base plate is exposed to the exterior. Consequently, there is a drawback that molybdenum exposed due to the crack and the processing object are reacted with each other to cause adhesion to the plate or degrade the performance of the plate. In the reference 5, the invention particularly aims at sintering of a pellet of oxides such as uranium dioxides or plutonium dioxides as nuclear reactor fuel, and influence to the exposed molybdenum is small. However, it is not possible to make long-term repetitive use in sintering of metal products such as MIM products or in an air such as a metallic and oxidization atmosphere that exerts an influence upon the molybdenum plate.

On the other hand, according to the present invention, it is possible to provide a setter used in sintering which can prevent the exposure of the base plate to thereby enable sintering of processing objects made of materials of a wide range, for example, even an object containing components such as nickel that is liable to react with molybdenum, and further, which is economical.

In the conventional method of forming the oxidation protective coating for refractory metal, as above-described in Reference 6, which discloses a method of forming a reaction barrier layer between a refractory metal and an oxidation protective coating made of silicide or aluminide by means of plasma spraying. The coating is alloyed with one or more metals of molybdenum or the like in a total proportion of 2 to 35 at %. However, in the conventional method, coating is provided only for an oxidation protection of the parent substance, i.e. base material and only for a reaction protection between the metal and the coatings, but is not for protection against melting adhesion of a processing object to the substance.

On the other hand, according to the present invention, the surface layer is made of an oxide layer, which is approximately selected depending on the processing object and has a function of melting adhesion of the object to the substance. Furthermore, an exposure area of the base material is kept at a range of 1% or less with respect to a unit area of the oxide coating layer so that degradation of performance is not caused by gas elements, such as Ni and the like.

Figure 8A:
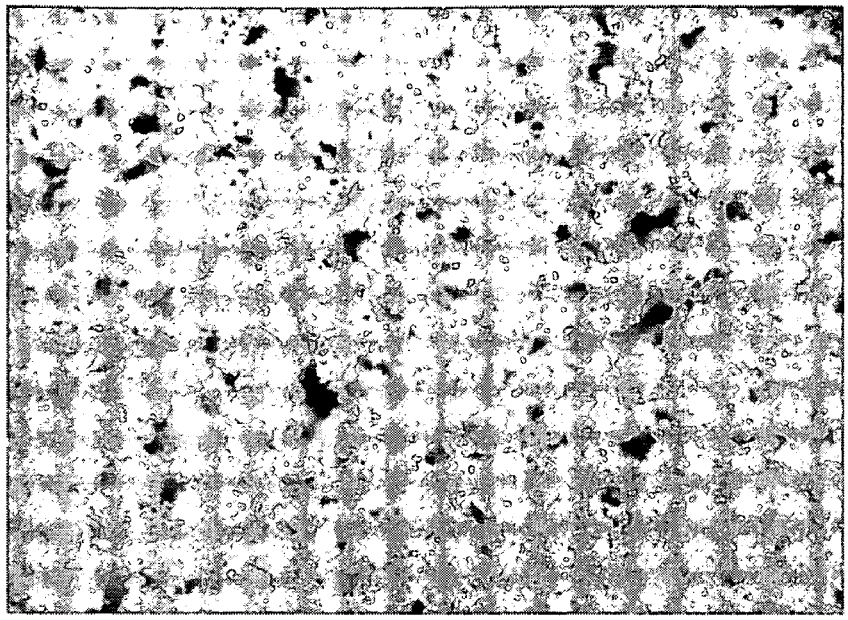
FIG. 8A is a comparative microphotograph showing the state of a structure of the surface of alumina after a heat treatment at 1800° C. when the powder grain size is 75 μm.
Figure 8B:
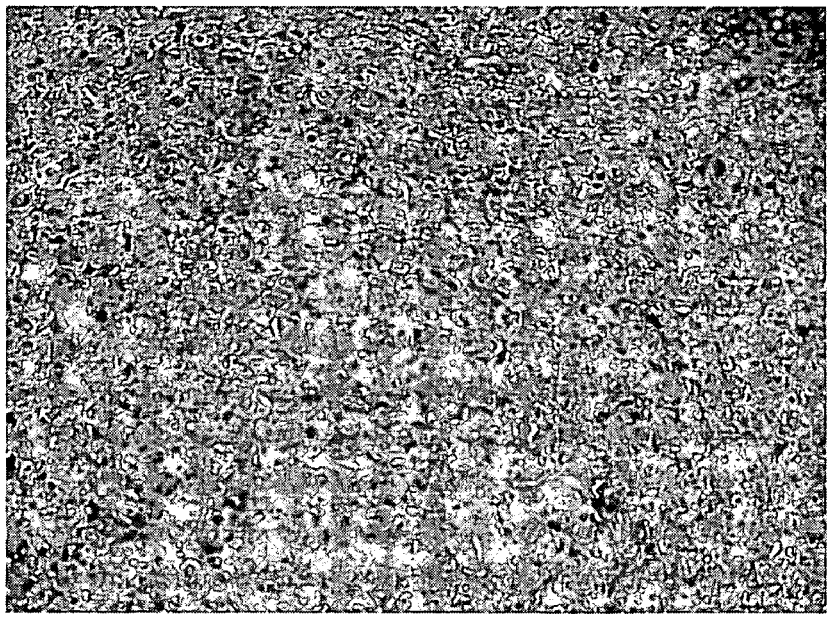
FIG. 8B is a comparative microphotograph showing the state of a structure of the surface of alumina after a heat treatment at 1800° C. when the powder grain size is 1 μm.

Now, a specific example about production of the setter used in sintering according to the present invention will be described with reference to FIGS. 8A and 8B. FIGS. 8A and 8B are comparative microphotographs showing the surfaces of alumina after a heat treatment in the different powder grain sizes.

First, samples 1 to 12 of the present invention will be described.

The surface roughness of a refractory metal plate having a high temperature deformation resistant characteristic, such as a molybdenum plate (thickness 1.5 mm×width 150 mm×length 300 mm), was increased by the honing process or the like for improving activation of the surface and adhesion of a deposited object, and herein, was set such that Ra was 4 μm and Rmax was 50 μm.

Powders of oxides to be deposited were measured according to compositions shown in Tables 1 and 2 below and fully mixed per sample by the use of a shaker mixer or a Henschel mixer. It became clear that, as shown in FIGS. 8A and 8B, the oxide powder used herein differed in melting condition depending on the grain size thereof even at the same heat treatment temperature. If it is fine powder, it will become possible to make it melting at low temperature. Herein, at least one kind of the oxide powders to be used was fine powder having a grain size of 10 μm or less. The composition can be desirably selected taking into account a using temperature and so forth.

Subsequently, the powders were dispersed into ethanol so as to be formed into slurries, which were then uniformly applied to target molybdenum plates by spraying or the like.

Plate warping was tested according to JIS H4483-1984 "3.3 Flatness" (reference 7).

In oxide coating layers of the present invention, compositions and heat treatment conditions can be changed depending on various oxide powders. Such an oxide coating layer is composed of an oxide coating film.

For example, using a composition of 20 wt % to 50 wt % zirconia (43 wt % zirconia in sample 2) with the remainder substantially composed of alumina as a surface layer, it is possible to obtain a sintering molybdenum plate having an oxide coating layer deposited from the surface layer via a heat treatment at 1500° C. or higher.

Using a composition of 1 wt % to 40 wt % titania (2.5 wt % titania in sample 3) with the remainder substantially composed of alumina as a surface layer, it is possible to obtain a sintering molybdenum plate having an oxide coating layer deposited from the surface layer via a heat treatment at 1500° C. or higher.

Using a composition of 20 wt % to 30 wt % silica (22 wt % silica in sample 4) with the remainder substantially composed of alumina as a surface layer, it is possible to obtain a sintering molybdenum plate having an oxide coating layer deposited from the surface layer via a heat treatment at 1500° C. or higher.

Using a composition of 5 wt % to 20 wt % yttria (6 wt % yttria in sample 5) with the remainder substantially composed of zirconia as a surface layer, it is possible to obtain a sintering molybdenum plate having an oxide coating layer deposited from the surface layer via a heat treatment at 1800° C. or higher.

Using a composition of 25 wt % to 35 wt % magnesia (29 wt % magnesia in sample 6) with the remainder substantially composed of alumina as a surface layer, it is possible to obtain a sintering molybdenum plate having an oxide coating layer deposited from the surface layer via a heat treatment at 1800° C. or higher.

Using a composition of 4 wt % to 30 wt % calcia (29 wt % calcia in sample 7) with the remainder substantially composed of alumina as a surface layer, it is possible to obtain a sintering molybdenum plate having an oxide coating layer deposited from the surface layer via a heat treatment at 1800° C. or higher.

In sample 12, individual slurry oxides were overlappingly applied in two layers and dried so as to be formed into a coating layer of two layers. In this case, for the purpose of improving adhesion, it is preferable to select, for the first layer, an oxide having a thermal expansion coefficient approximate to that of the plate as a base material, and select, for the uppermost layer, an oxide taking into account melting adhesion due to a reaction between the base material and a processing object to be sintered.

In the present invention, in case of, for example, the molybdenum plate, $Al_2O_3$-2.5% $TiO_2$ (thermal expansion coefficient: about 5.3 ($\times 10^{-}$/° C.)) having a thermal expansion coefficient approximate to that (about 5.0 ($\times 10^{-6}$/° C.)) of molybdenum was used for the first layer.

After the application, the oxides were engaged with roughness of the plate surface so as to be disposed by applying a baking process for two hours or more at a temperature depending on the grain size of the oxide to be deposited, i.e. at 1500° C. herein. Consequently, plates were produced each having both given smoothness and porosity as a characteristic of the deposition surface as shown in Tables 1 and 2 below and FIGS. 8A and 8B.

In Tables 2, 3, and 4 shown below, a sintering object corresponds to a processing one described in the specification.

Further, by polishing the surface of the oxide coating layer, an oxide coating layer having a smoother and more porous state was obtained.

Subsequently, samples 13 to 19 of reference examples will be described.

Sample 13 was prepared by applying a coating layer of $Al_2O_3$-43% $ZrO_2$ in a thickness of 8 μm onto a molybdenum plate like the one in the example of the present invention, then applying a baking process like in the example of the present invention.

Sample 14 was prepared by applying a coating layer of $Al_2O_3$-43% $ZrO_2$ in a thickness of 350 μm onto a molybdenum plate like the one in the example of the present invention, then applying a baking process like in the example of the present invention. However, the coating layer was peeled off from the molybdenum plate, and warping of several millimeters or more was generated, so that it was unusable as a floor plate.

Sample 15 was prepared by applying a coating layer of $Al_2O_3$-43% $ZrO_2$ in a thickness of 100 μm, using $Al_2O_3$ of 30 μm, onto a molybdenum plate like the one in the example of the present invention, then applying a baking process like in the example of the present invention.

Sample 16 was prepared by applying a coating layer in a thickness of 100 μm, using only $Al_2O_3$ of 30 μm, onto a molybdenum plate like the one in the example of the present invention, then applying a baking process like in the example of the present invention.

Sample 17 was prepared by further roughening the surface of the molybdenum plate to provide the surface roughness of Ra=21 μm and Rmax=160 μm, and applying a coating layer of $Al_2O_3$-43% $ZrO_2$ in a thickness of 100 μm onto the further roughened surface.

Sample 18 was prepared by applying no coating layer onto a molybdenum plate like the one in the example of the present invention.

Sample 19 was prepared by applying a coating layer of $Al_2O_3$-50% molybdenum in a thickness of 100 μm, using $Al_2O_3$ of 30 μm and molybdenum powder of 3.5 μm, onto a molybdenum plate like the one in the example of the present invention, then applying a baking process like in the example of the present invention.

Subsequently, comparative samples 20 and 21 will be described.

As sample 20 according to a comparative example, an $Al_2O_3$ plate having a thickness of 10 mm, which is used currently, was prepared.

Sample 21 according to a comparative example was prepared by plasma spraying a coating layer in a thickness of 100 μm, using only $Al_2O_3$ of 30 μm, onto a molybdenum plate with an uncontrolled structure.

Figure 9B:
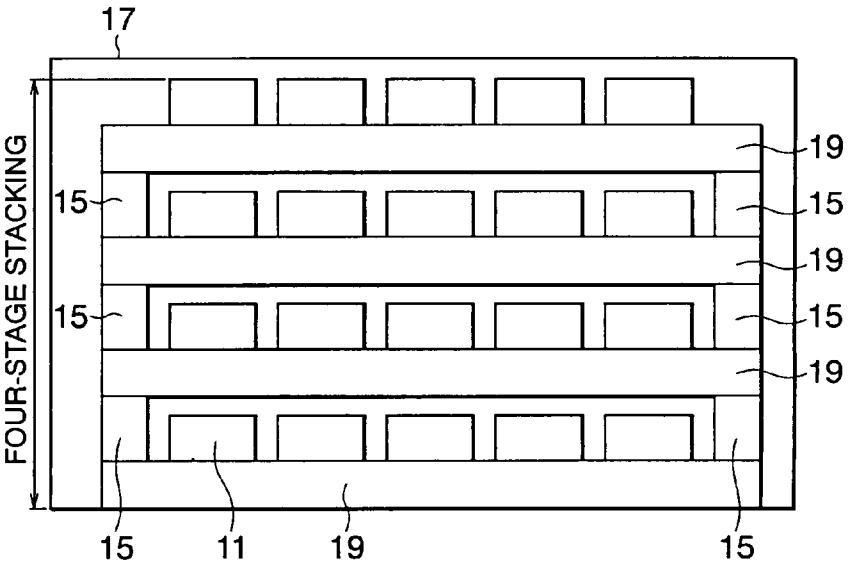
FIG. 9B is a view for use in explaining an example of comparative sample 20 inserting into the furnace according to the present invention.
Figure 9A:
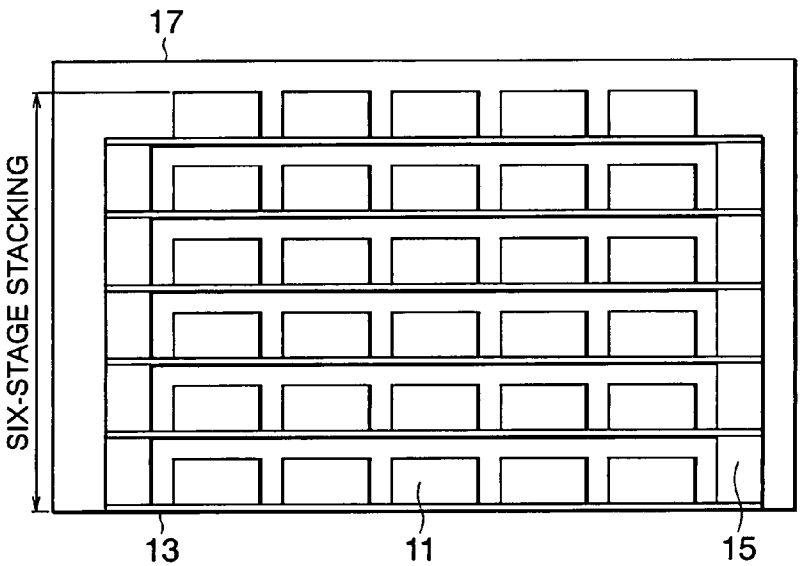
FIG. 9A is a view for use in explaining an example inserting MIM sintering bodies into a furnace according to the present invention.

In an example shown in FIG. 9A according to the present invention, fifty iron series MIM products 11 each having a diameter of 20 mm and a height of 10 mm were placed on a molybdenum plate having a thickness of 1.5 mm, a length of 150 mm, and a width of 30 mm, then a spacer 15 having a diameter of 10 mm and a height of 15 mm was arranged around the molybdenum plate, and then six molybdenum plates each having thereon the same fifty MIM products were stacked one by one so that the six molybdenum plates with the MIM products were stacked in six steps in total. The molybdenum plates stacked in six steps were inserted into a meshbelt furnace having an opening portion 17 with a width of 170 mm and a height of 100 mm, then subjected to a sintering process in a hydrogen atmosphere at 1350° C. for two hours, to thereby obtain MIM sintered bodies. In an example shown in FIG. 9B according to the comparative example, MIM products 11 were placed on a normal alumina plate having a thickness of 10 mm, a length of 150 mm, and a width of 300 mm to form in a four stage stacking state in a similar manner mentioned above.

As compared with sample 20 according to the comparative example using the normal alumina plate, the charge amount of the products was 1.5 times, and the power consumption for the furnace was reduced to about 70%.

The MIM sintered bodies were not subjected to the melting adhesion to the molybdenum plates, and were excellent in surface condition. Further, the molybdenum plates were not subjected to occurrence of new waving or peeling of the coating layers, and were thus usable repeatedly.

With respect also to samples 13 and 15-19 according to the reference examples and samples 20 and 21 according to the comparative examples, the sintering process was carried out with the MIM products placed on the plates in the same manner. With respect to sample 20 according to the comparative example, however, since the $Al_2O_3$ plate was large in thickness, the plates were stacked in four steps.

The results were as follows.

Since the coating layer was thin in reference sample 13, there was a portion where molybdenum was exposed so that part of the MIM sintered bodies were subjected to the melting adhesion to the molybdenum plate and thus were unusable as the products. This sample was observed using microscope at 150 magnification to analyze an image thereof and, as a result, the exposed portion of the molybdenum plate was about 2% of a unit area.

With respect to reference samples 15 and 16, since only the coarse powder was used for the coating layer, the coating layer was poor in adhesion to the molybdenum plate and thus was liable to peel off the molybdenum plate, so that the coating layer was adhered to the surfaces of the sintered bodies, which were thus unusable as the products.

With respect to reference sample 17, the roughness of the coating layer surface was transferred onto the surfaces of the MIM sintered bodies, and therefore, the MIM sintered bodies were unusable as the products.

With respect to reference sample 18, since there was no coating layer, molybdenum and the MIM sintered bodies were subjected to the melting adhesion, and therefore, the MIM sintered bodies were unusable as the products.

With respect to reference sample 19, since molybdenum was exposed in the coating layer and on the surface thereof, the MIM sintered bodies were subjected to the melting adhesion and thus were unusable as the products.

With respect to comparative sample 20, the obtained MIM sintered bodies themselves were excellent. However, since the charge amount to the furnace was small and the consumption electrical power was large, the cost was increased.

With respect to comparative sample 21, since the structure of molybdenum was not controlled and further only the coarse powder was used, new warping was caused during sintering of the MIM products, and the coating layer was peeled off the plate and adhered to the MIM sintered bodies, so that repetitive use was not possible.

With respect to the reference samples and the comparative samples, the repetitive use was not possible due to occurrence of the melting adhesion of the processing objects onto the molybdenum plate, occurrence of new warping of the molybdenum plate, occurrence of peeling of the coating layer, and so forth.

For example, as shown in FIGS. 7A and 7B, the coating layer was polished in sample 8 of the present invention, while, in case of sample 17 according to the reference example, there is large roughness so that the surface roughness is transferred to the MIM sintered bodies which thus can not be used as the products.

Subsequently, using a mixture of powders of alumina having a grain size of about 1 μm and titania of 30 μm like in the example of the present invention, a coating layer was prepared by plasma spraying such powders and applying thereto a heat treatment at 1500° C. for two hours, so that the coating layer with no exposure of a base plate was obtained. Then, MIM sintered bodies were prepared using the plate with such a coating layer, and the excellent MIM sintered bodies like in the example of the present invention were obtained. This was also applied to the foregoing other oxides.

Further, after preparing a coating layer of 50 μm like in the example of the present invention, a coating layer of 50 μm was formed by plasma spraying thereto using a mixture of powders of zirconia having a grain size of about 3 μm and yttria of 30 μm and, by applying thereto a heat treatment at 1500° C. for two hours, a coating layer having a thickness of 100 μm in total was prepared. Then, MIM sintered bodies were prepared using the plate with such a coating layer, and the excellent MIM sintered bodies like in the example of the present invention were obtained. This was also applied to combinations of the foregoing other oxides. Further, even when the coating layer by the plasma spraying was prepared first, which was inverse to the foregoing, the same result was obtained.

Further, using a mixture of powders of alumina having a grain size of about 1 μm and zirconia of 30 μm like in the example of the present invention, a heat resistant inorganic adhesive was added to the mixture of powders, which was then applied to a molybdenum plate and subjected to a heat treatment at 1500° C. for two hours, so that a coating layer with no exposure of the base plate was obtained like in the foregoing. Then, MIM sintered bodies were prepared using the plate with such a coating layer, and the excellent MIM sintered bodies like in the example of the present invention were obtained. This was also applied to the foregoing other oxides.

Using the molybdenum plate deposited with alumina of 1 μm and 43% zirconia of 30 μm in sample 2 of the example of the present invention, a test of oxidation resistance in the air was conducted. In the oxidation resistant test, the coating layer, when existing, covered the whole surface of the plate. The oxidization resistant test was carried out in the air at 600° C. for five hours, which was the condition where removal of binder was carried out, wherein a decreased weight of the molybdenum plate thereupon was given as an attrition rate. As a result, in case of a 99.9% molybdenum plate with no coating layer, sublimation of molybdenum advanced so that the attrition rate reached 20 to 25%. In case of the molybdenum plate prepared by the conventional plasma spraying method, the attrition rate reached 5 to 10%.

On the other hand, in case of the molybdenum plate deposited with alumina of 1 μm and 43% zirconia of 30 μm in sample 2 of the example of the present invention, the attrition rate was less than 1%.

As clear from the foregoing examples, it is possible to obtain the coating layer with no exposure of the base plate to thereby obtain the setter used in sintering which is excellent in oxidation resistant characteristic, by setting the grain size of at least one kind of powder to 10 μm or less.

Subsequently, using tungsten, instead of molybdenum, as a metal of a setter used in sintering according to the present invention, review was performed like in the foregoing examples. As a result, as shown in Tables 3 and 4 below, characteristics similar to those in case of molybdenum were obtained even in case of tungsten. Incidentally, in Tables 3 and 4, samples 22 to 33 are based on examples of the present invention, while samples 34 to 40 are based on reference examples.

As described above, according to the present invention, it is possible to obtain the setter used in sintering that can accomplish the object of sintering the processing object with the thickness of about 1 to 2 mm when, for example, the oxides are deposited to the molybdenum plate, while the thickness of about 10 to 15 mm is required conventionally when the high temperature resistant material such as alumina or silica is used as the setter used in sintering. Further, the setter used in sintering according to the present invention can largely save the energy used for heating and cooling to thereby provide a large economical effect.

TABLE 1

| | | plate | | | coating layer | | |
|---|---|---|---|---|---|---|---|
| | | material | Ra/Rmax (μm) | thickness (mm) | composition | coating layer thickness (μm) | Ra/Rmax (μm) |
| present invention | 1 | plate with controlled structure of Mo | 4/50 | 1.5 | (1 μm)$Al_2O_3$ | 100 | 6/75 |
| | 2 | | | | (1 μm)$Al_2O_3$ - 43%(30 μm)$ZrO_2$ | 100 | 4/50 |
| | 3 | | | | (1 μm)$Al_2O_3$ - 2.5% $TiO_2$ | 100 | 4/50 |
| | 4 | | | | (1 μm)$Al_2O_3$ - 22% $SiO_2$ | 100 | 5/60 |
| | 5 | | | | (3 μm)$ZrO_2$ - 6% $Y_2O_3$ | 100 | 8/100 |
| | 6 | | | | (1 μm)$Al_2O_3$ - 29% MgO | 100 | 7/85 |
| | 7 | | | | (3 μm)$ZrO_2$ - 29% CaO | 100 | 5/60 |
| | 8 | | | | (1 μm)$Al_2O_3$ - 43%(30 μm)$ZrO_2$ polished | 100 | 4/40 |
| | 9 | | | | (1 μm)$Al_2O_3$ - 43%(30 μm)$ZrO_2$ | 10 | 4/50 |
| | 10 | | | | | 300 | 4/50 |
| | 11 | | | | mixture of fine and coarse powders $Al_2O_3$ - 43%(30 μm)$ZrO_2$ | 100 | 20/150 |
| | 12 | | | | lower layer: (1 μm)$Al_2O_3$ - 2.5% $TiO_2$<br>upper layer: (3 μm)$ZrO_2$ - 6% $Y_2O_3$ | 50<br>50 | 4/50 |
| reference example | 13 | plate with controlled structure of Mo | 4/50 | 1.5 | (1 μm)$Al_2O_3$ - 43%(30 μm)$ZrO_2$ | 8 | 4/50 |
| | 14 | | | | | 350 | 4/50 |
| | 15 | | | | (30 μm)$Al_2O_3$ - 43%(30 μm)$ZrO_2$ | 100 | 18/130 |
| | 16 | | | | (30 μm)$Al_2O_3$ | 100 | 18/130 |
| | 17 | | 21/160 | | (1 μm)$Al_2O_3$ - 43% $ZrO_2$ | 100 | 21/160 |
| | 18 | | 4/50 | | — | — | — |
| | 19 | | | | Mo powder - 50%(30 μm)$Al_2O_3$ | 100 | 18/130 |
| comparative example | 20 | $Al_2O_3$ | 2/15 | 10 | — | — | — |
| | 21 | plate with controlled structure of Mo | 4/50 | 1.5 | (30 μm)$Al_2O_3$ | 100 | 18/130 |

TABLE 2

| | | sintering object | after sintering of product | | | | |
|---|---|---|---|---|---|---|---|
| | | amount charged into furnace | without melting and adhesion | soundness of coating layer | warping | soundness of product | durability test number of times of excellent sintering |
| present invention | 1 | ○: 300 | ○ | ○ | ○ | ○ | 50 |
| | 2 | ○: 300 | ○ | ○ | ○ | ○ | 100 |
| | 3 | ○: 300 | ○ | ○ | ○ | ○ | 80 |
| | 4 | ○: 300 | ○ | ○ | ○ | ○ | 75 |
| | 5 | ○: 300 | ○ | ○ | ○ | ○ | 100 |
| | 6 | ○: 300 | ○ | ○ | ○ | ○ | 75 |
| | 7 | ○: 300 | ○ | ○ | ○ | ○ | 70 |
| | 8 | ○: 300 | ○ | ○ | ○ | ○ | 100 |
| | 9 | ○: 300 | ○ | ○ | ○ | ○ | 100 |
| | 10 | ○: 300 | ○ | ○ | ○ | ○ | 100 |
| | 11 | ○: 300 | ○ | ○ | ○ | ○ | 100 |
| | 12 | ○: 300 | ○ | ○ | ○ | ○ | 100 |
| reference example | 13 | ○: 300 | X | ○ | ○ | X | 3 |
| | 14 | ○: 300 | ○ | X (peel) | X | — | 0 |
| | 15 | ○: 300 | ○ | X (peel) | ○ | X (coating layer adhered) | 0 |
| | 16 | ○: 300 | ○ | X (peel) | ○ | X (coating layer adhered) | 0 |
| | 17 | ○: 300 | ○ | ○ | ○ | X (surface rough) | 0 |
| | 18 | ○: 300 | X | — | ○ | X | 0 |
| | 19 | ○: 300 | X | X | ○ | X | 0 |

TABLE 2-continued

| | | sintering object | after sintering of product | | | | |
|---|---|---|---|---|---|---|---|
| | | amount charged into furnace | without melting and adhesion | soundness of coating layer | warping | soundness of product | durability test number of times of excellent sintering |
| comparative example | 20 | Δ: 200 | ○ | ○ | ○ | ○ | 100 |
| | 21 | ○: 300 | ○ | X (peel) | X | X (coating layer adhered) | 5 |

○: good
Δ: no good
X: completely no good
—: none

TABLE 3

| | | plate | | | coating layer | | |
|---|---|---|---|---|---|---|---|
| | | material | Ra/Rmax (μm) | thickness (mm) | composition | coating layer thickness (μm) | Ra/Rmax (μm) |
| present invention | 22 | W plate | 4/50 | 1.5 | (1 μm)$Al_2O_3$ | 100 | 7/85 |
| | 23 | | | | (1 μm)$Al_2O_3$ - 43%(30 μm)$ZrO_2$ | 100 | 5/60 |
| | 24 | | | | (1 μm)$Al_2O_3$ - 2.5% $TiO_2$ | 100 | 5/60 |
| | 25 | | | | (1 μm)$Al_2O_3$ - 22% $SiO_2$ | 100 | 6/70 |
| | 26 | | | | (3 μm)$ZrO_2$ - 6% $Y_2O_3$ | 100 | 9/110 |
| | 27 | | | | (1 μm)$Al_2O_3$ - 29% MgO | 100 | 8/95 |
| | 28 | | | | (3 μm)$ZrO_2$ - 29% CaO | 100 | 6/70 |
| | 29 | | | | (1 μm)$Al_2O_3$ - 43%(30 μm)$ZrO_2$ polished | 100 | 4/40 |
| | 30 | | | | (1 μm)$Al_2O_3$ - 43%(30 μm)$ZrO_2$ | 10 | 5/60 |
| | 31 | | | | | 300 | 5/60 |
| | 32 | | | | mixture of fine and coarse powders $Al_2O_3$ - 43%(30 μm)$ZrO_2$ | 100 | 20/150 |
| | 33 | | | | lower layer: (1 μm)$Al_2O_3$ - 2.5% $TiO_2$ | 50 | 4/50 |
| | | | | | upper layer: (3 μm)$ZrO_2$ - 6% $Y_2O_3$ | 50 | |
| reference example | 34 | W plate | 4/50 | 1.5 | (1 μm)$Al_2O_3$ - 43%(30 μm)$ZrO_2$ | 8 | 4/50 |
| | 35 | | | | | 350 | 4/50 |
| | 36 | | | | (30 μm)$Al_2O_3$ - 43%(30 μm)$ZrO_2$ | 100 | 20/150 |
| | 37 | | | | (30 μm)$Al_2O_3$ | 100 | 20/150 |
| | 38 | | 21/160 | | (1 μm)$Al_2O_3$ - 43% $ZrO_2$ | 100 | 21/160 |
| | 39 | | 4/50 | | — | — | — |
| | 40 | | | | Mo powder - 50%(30 μm)$Al_2O_3$ | 100 | 18/130 |

TABLE 4

| | | sintering object | after sintering of product | | | | |
|---|---|---|---|---|---|---|---|
| | | amount charged into furnace | without melting and adhesion | soundness of coating layer | warping | soundness of product | durability test number of times of excellent sintering |
| present invention | 22 | ○: 300 | ○ | ○ | ○ | ○ | 55 |
| | 23 | ○: 300 | ○ | ○ | ○ | ○ | 100 |
| | 24 | ○: 300 | ○ | ○ | ○ | ○ | 85 |
| | 25 | ○: 300 | ○ | ○ | ○ | ○ | 80 |
| | 26 | ○: 300 | ○ | ○ | ○ | ○ | 100 |
| | 27 | ○: 300 | ○ | ○ | ○ | ○ | 80 |
| | 28 | ○: 300 | ○ | ○ | ○ | ○ | 75 |
| | 29 | ○: 300 | ○ | ○ | ○ | ○ | 100 |
| | 30 | ○: 300 | ○ | ○ | ○ | ○ | 100 |
| | 31 | ○: 300 | ○ | ○ | ○ | ○ | 100 |
| | 32 | ○: 300 | ○ | ○ | ○ | ○ | 100 |
| | 33 | ○: 300 | ○ | ○ | ○ | ○ | 100 |
| reference example | 34 | ○: 300 | X | ○ | ○ | X | 3 |
| | 35 | ○: 300 | ○ | X (peel) | X | — | 0 |
| | 36 | ○: 300 | ○ | X (peel) | ○ | X (coating layer adhered) | 0 |
| | 37 | ○: 300 | ○ | X (peel) | ○ | X (coating layer adhered) | 0 |
| | 38 | ○: 300 | ○ | ○ | ○ | X (surface rough) | 0 |

TABLE 4-continued

| | sintering object | after sintering of product | | | | |
|---|---|---|---|---|---|---|
| | amount charged into furnace | without melting and adhesion | soundness of coating layer | warping | soundness of product | durability test number of times of excellent sintering |
| 39 | ○: 300 | X | — | ○ | X | 0 |
| 40 | ○: 300 | X | X | ○ | X | 0 |

○: good
X: no good
—: none

Further, according to the present invention, it is possible to obtain the refractory metal plate having both the excellent binder removing property and the excellent sintering characteristics by providing the porous and smooth oxide coating layer, and further obtain the method of producing it and the setter which is used in sintering and which uses the refractory metal plate.

Further, according to the present invention, it is possible to obtain the refractory metal plate that can prevent alumina or the like from adhering to the product owing to the oxides being deposited, so that a post treatment is not required and the quality of the sintered product is improved to thereby achieve an economical effect, and further obtain the method of producing it and the setter which is used in sintering and which uses the refractory metal plate.

Conventionally, in case of the iron series material, components, such as nickel, contained therein are reacted with molybdenum to significantly deteriorate the performance of the molybdenum plate. On the other hand, according to the present invention, it is possible to obtain the refractory metal plate which has the deposition surface with no exposure of molybdenum, tungsten, or the alloy thereof being the base material, and therefore, which can be used without degrading the performance of the molybdenum plate, and further obtain the method of producing it and the setter which is used in sintering and which uses the refractory metal plate.

Conventionally, the molybdenum plate is significantly oxidized at 500° C. or higher in the air, and therefore, can not be used. On the other hand, according to the present invention, it is possible to obtain the refractory metal plate that can be used even in the air by depositing the oxide coating layer over the whole surface, and further obtain the method of producing it and the setter which is used in sintering and which uses the refractory metal plate. In this case, the coating layer is preferably thick, i.e. in a range of 50 μm to 300 μm.

Although the present invention has thus far been described in conjunction with the preferred embodiments thereof, it will readily be understood for those skilled in the art to put the present invention into practice in various other manners without departing from the scope of the appended claims.

What is claimed is:

1. A refractory metal plate comprising:

a metal plate made of a base material and having at least one surface, said base material comprising at least one of molybdenum, tungsten, molybdenum alloys and tungsten alloys; and an oxide coating layer formed by depositing oxide powder of at least one of oxide powders of alumina, silica, zirconia, yttria, titania, magnesia, and calcia onto said at least one surface, wherein said oxide coating layer covers the whole of said at least one surface, the exposure of said base material being equal to or less than 1% of a unit area of the oxide coating layer, and wherein, the coated metal plate is a base plate, and a surface roughness thereof is such that Ra is 20 μm or less and Rmax is 150 μm or less.

2. The refractory metal plate according to claim 1, wherein at least one kind of said oxide powders is set to 10 μm or less, and said oxide coating layer is obtained by implementing a heat treatment at a temperature depending on the grain size of said powder.

3. The refractory metal plate according to claim 1, wherein a thickness of said oxide coating layer is set to 10 to 300 μm.

4. The refractory metal plate according to claim 1, wherein a surface of said oxide coating layer is porous, and a surface roughness thereof is such that Ra is 20 μm or less and Rmax is 150 μm or less.

5. The refractory metal plate according to claim 1, wherein said oxide coating layer is formed by plasma spraying.

6. The refractory metal plate according to claim 1, wherein said oxide coating layer is formed on a surface of a plate by forming slurry by mixing oxide with a solvent, painting the slurry with a brush or spraying the slurry on a base material, drying the slurry on the base material, then applying a melting process at a temperature depending on a grain size of the oxides to be deposited.

7. The refractory metal plate according to claim 1, wherein said oxide coating layer is formed by forming an oxide coating layer by the use of a high temperature resistant adhesive, then applying a heat treatment so as to deposit it.

8. A setter used in sintering, comprising the refractory metal plate according to claim 1.

9. A refractory metal plate comprising:

a molybdenum plate having a composition of 99.9% or more purity and having a high temperature deformation resistant characteristic, said plate having at least one surface;

an oxide coating layer formed by depositing oxide powder of at least one of oxide powders of alumina, silica, zirconia, yttria, titania, magnesia, and calcia to said at least one surface of said plate, wherein a size of a disk-shaped crystal grain contained inside said molybdenum plate is such that a ratio of a longer diameter relative to a shorter diameter of a disk surface is four or less, a diameter of a disk surface of said molybdenum crystal grains is 15 mm to 150 mm, and crystal grains account for ⅕ or more of a thickness in a thickness direction of said molybdenum plate, the exposure of a base material being equal to or less than 1% of a unit area of the oxide coating layer, and wherein, the coated metal plate is a base plate, and a surface roughness thereof is such that Ra is 20 μm or less and Rmax is 150 μm or less.

10. A setter used in sintering, comprising the refractory metal plate according to claim 9.

11. The refractory metal plate according to claim 9, wherein said oxide coating layer is formed by plasma spraying.

12. The refractory metal plate according to claim 9, wherein said oxide coating layer is formed on a surface of a plate by forming slurry by mixing oxide with a solvent, painting the slurry with a brush or spraying the slurry on a base material, drying the slurry on the base material, then applying a melting process at a temperature depending on a grain size of the oxides to be deposited.

13. The refractory metal plate according to claim 9, wherein said oxide coating layer is formed by forming an oxide coating layer by the use of a high temperature resistant adhesive, then applying a heat treatment so as to deposit it.

14. A refractory metal plate comprising:

a metal plate having at least one surface;

an oxide coating layer on said at least one surface, said layer being formed by depositing oxide powder of at least one of oxide powders of alumina, silica, zirconia, yttria, titania, magnesia, and calcia to said at least one surface of said plate, wherein said plate has a composition of 0.1 to 1.0 wt % lanthanum or lanthanum oxides with the remainder composed of molybdenum, has a structure extending in a substantially fixed direction, and is small in deformation amount at a high temperature, the exposure of a base material being equal to or less than 1% of a unit area of the oxide coating layer, and wherein, the coated metal plate is a base plate, and a surface roughness thereof is such that Ra is 20 μm or less and Rmax is 150 μm or less.

15. A setter used in sintering, comprising the refractory metal plate according to claim 14.

16. The refractory metal plate according to claim 14, wherein said oxide coating layer is formed by plasma spraying.

17. The refractory metal plate according to claim 14, wherein said oxide coating layer is formed on a surface of a plate by forming slurry by mixing oxide with a solvent, painting the slurry with a brush or spraying the slurry on a base material, drying the slurry on the base material, then applying a melting process at a temperature depending on a grain size of the oxides to be deposited.

18. The refractory metal plate according to claim 14, wherein said oxide coating layer is formed by forming an oxide coating layer by the use of a high temperature resistant adhesive, then applying a heat treatment so as to deposit it.

19. The refractory metal plate according to claim 14, wherein said plate has crystal grains exhibiting an interlocking structure in which the structure extends in a fixed direction so as to be recrystallized, and is excellent in processability and high temperature deformation resistance.

20. A setter which is used in sintering and which comprises the refractory metal plate according to claim 19.

21. The refractory metal plate according to claim 19, wherein said oxide coating layer is formed by plasma spraying.

22. The refractory metal plate according to claim 19, wherein said oxide coating layer is formed on a surface of a plate by forming slurry by mixing oxide with a solvent, painting the slurry with a brush or spraying the slurry on a base material, drying the slurry on the base material, then applying a melting process at a temperature depending on a grain size of the oxides to be deposited.

23. The refractory metal plate according to claim 19, wherein said oxide coating layer is formed by forming an oxide coating layer by the use of a high temperature resistant adhesive, then applying a heat treatment so as to deposit it.

* * * * *